United States Patent [19]

Berthelot et al.

[11] 4,081,393

[45] Mar. 28, 1978

[54] ELECTRICAL INSULATING OILS CONTAINING TRIALKYL BENZENES

[75] Inventors: Jean-Paul Berthelot, Mont-Saint-Aignan; Pierre Dominique Marin, Rouen, both of France

[73] Assignee: Exxon Research & Engineering Co., Linden, N.J.

[21] Appl. No.: 751,054

[22] Filed: Dec. 15, 1976

[30] Foreign Application Priority Data

Dec. 16, 1975 United Kingdom ..... 51431/75
Feb. 4, 1976 United Kingdom ..... 4365/76

[51] Int. Cl.[2] ..... C10M 1/16; H01B 3/22
[52] U.S. Cl. ..... 252/63
[58] Field of Search ..... 252/63; 174/17 LF; 336/94; 174/25 R, 25 C; 208/14

[56] References Cited

U.S. PATENT DOCUMENTS

| | | | |
|---|---|---|---|
| 2,810,769 | 10/1957 | Sanford et al. | 252/63 X |
| 2,810,770 | 10/1957 | Sanford et al. | 252/63 X |
| 3,036,010 | 5/1962 | Freier et al. | 252/63 |
| 3,163,705 | 12/1964 | Feick et al. | 252/63 X |
| 3,673,093 | 6/1972 | Rocchi | 252/63 X |

FOREIGN PATENT DOCUMENTS

| | | |
|---|---|---|
| 1,142,047 | 2/1969 | United Kingdom. |

*Primary Examiner*—Harris A. Pitlick
*Attorney, Agent, or Firm*—Frank T. Johmann

[57] ABSTRACT

Electrical oils which are blends of specified trialkyl benzenes and mineral oils have improved gas absorption and oxidation stability.

8 Claims, 2 Drawing Figures

ELECTRICAL INSULATING OILS CONTAINING TRIALKYL BENZENES

The present invention relates to electrical insulating oils particularly oils to be used in hollow core cables and transformer insulation.

An oil requires certain properties to be useful as an electrical oil. It should have a low viscosity, a high oxidation stability to prevent oxidative breakdown of the insulant, a high boiling point to prevent loss of insulant due to the high temperatures generated during use of electrical apparatus and a flash point preferably above 140° C. It is of course also important that the oil have good insulating properties (i.e. high dielectric strength). One particular property which is lacking in many electrical oils is ability to absorb sufficient hydrogen which can lead to the liberated hydrogen destroying the insulation provided by the oil. This invention is concerned with electrical oils that have an improved ability to absorb hydrogen consistent with the desired oxidation stability.

U.S. Pat. No. 2,810,770 which is concerned with the production of polyalkyl benzenes describes certain trialkyl benzenes and suggests they may be useful as electrical electrical oils. We have found that although certain trialkyl benzenes have good hydrogen absorption properties in contrast to the teaching of U.S. Pat. No. 2,810,770 they do not have sufficient oxidation stability to be useful as electrical oils. U.S. Pat. No. 3,163,705 suggests that the desired combination of oxidation stability and gas absorption may be achieved by blending certain polyalkyl benzenes with a mineral oil. We find that the choice of the polyalkyl benzene used in these blends is critical and that electrical oils having particularly advantageous hydrogen absorption and oxidation stability properties are obtained if a trialkyl benzene of a particular structure is used in such a blend.

The present invention therefore provides an electrical insulating oil comprising from 5 to 80% by weight of a trialkyl benzene of the general formula

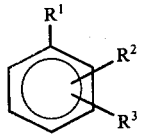

where $R_1$, $R_2$ and $R_3$ are all alkyl groups $R_1$ and $R_2$ containing no more than 6 carbon atoms and $R_3$ containing from 5 to 15 carbon atoms and from 95% to 20% by weight of a mineral oil.

We prefer that two of the alkyl groups in the trialkyl benzene are short chain (i.e. contain no more than 3 carbon atoms) since these compounds have lower viscosity. Most preferably the trialkyl benzenes are derived from ortho-xylene where $R_1 = R_2 = CH_3$. In these circumstances we prefer that $R_3$ contains at least five carbon atoms preferably from five to 15, most preferably nine to 12. The trialkyl benzenes in which $R_1 = R_2 = CH_3$ and $R_3$ is $C_9H_{19}$ or $C_{12}H_{25}$ are our preferred.

Hydrogen is often liberated due to degradation of the electrical oil which can lead to complete breakdown of the insulation and thus if the electrical oil is capable of absorbing hydrogen this risk of breakdown may be reduced. We have found that the trialkyl benzenes of the type used in the blends of our invention have improved hydrogen absorption compared with similar dialkyl and mono alkyl benzenes and also compared with other trialkyl benzenes.

Although the trialkyl benzenes have good hydrogen absorption properties their oxidation stability is poor and they cannot satisfactorily be used on their own as electrical oils. However, we have found that this oxidation stability may be improved sufficiently to provide a useful electrical oil by blending the trialkyl benzene with at least 20% by weight of the total oil composition of a mineral oil. The exact amount of mineral oil that is used will of course depend upon the exact use to which the oil is to be put and also on the relative costs of the components. We find that the ability of the oil to absorb hydrogen decreases as the amount of mineral oil increases and that the composition should contain no more than 90% by weight of the mineral oil. Our preferred compositions contain from 25 to 85% by weight of the mineral oil more preferably 25 to 35% by weight.

The mineral oil portion of the electrical insulating oil may be any mineral oil and may be either paraffinic or naphthenic although we prefer to use the paraffinic mineral oils hitherto used as electrical oils.

The oils of the present invention may be used as transformer or circuit breaker oils or in cable oils for hollow cables. The exact nature of the trialkyl benzene and the relative properties of the components of the blend will depend upon the properties of the oil required for a particular use. For example transformer or circuit breaker oils should have low viscosity, high flash point, high dielectric strength and low volatility. Cable oils, particularly for use in hollow cables should provide low power loss consistent with electrical and chemical stability.

The electrical oils of the present invention may contain any of the additives traditionally used the need being according to the use of the oil. Examples of additives include antioxidants and pour depressants.

The present invention is illustrated but in no way limited by reference to Examples 1 and 3 of the following Examples and to the drawings, wherein.

EXAMPLE 1

Blends containing varying amounts of nonyl orthoxylene and a mineral oil having a density of 0.854 at 20° C a viscosity of 18.7 cst at 20° C and whose infra red analysis showed 9% wt.% aromatic carbon atoms, 54 wt.% paraffinic carbons and 37 wt.% naphthenic carbons were prepared and tested for oxidation stability and gas absorption. The oxidation stability was measured by the Standard International Electrotechnical Commission Test in which oxygen is passed through a sample of oil containing a copper strip, the oil being at 100° C and the oxygen passed for 164 hours. The acid index (the number of milligrams of potasium hydroxide required to neutralise 1 gram of the oil) gave a measure of the oxidation stability of the oil. The lower the acid index the greater the oxidation stability.

The amount of sludge formed during the test was also measured.

The hydrogen absorption was measured in a Trafo-Union cell at a temperature of 80° C and a tension of 12 kilovolts corresponding to a mean applied field of 4.5 volts/micron.

The absorption of hydrogen follows the law $$V = V_1(1-e^{-Kt})$$

where $V$ is the rate of absorption at any one time ($t$), $V_1$ is the initial rate of absorption and K is the absorption coefficient.

The results of the oxidation stability tests were as follows:

| Composition of Blend | | | Sludge |
|---|---|---|---|
| % by weight of Mineral Oil | % by weight of $C_9$ orthoxylene | Acid Index (mg KOH/g) | % of weight of total |
| 100 | — | 0.06 | 0.01 |
| 50 | 50 | 0.07 | 0.03 |
| 25 | 75 | 0.12 | 0.03 |
| 15 | 85 | 0.48 | 0 |
| — | 100 | 6.9 | 0 |

The results of the hydrogen absorption test were as follows:

| Composition of Blend | | |
|---|---|---|
| % of weight of Mineral Oil | % by weight of $C_9$ orthoxylene | Absorption Coefficient K(hours$^{-1}$) |
| 100 | — | 0 |
| 50 | 50 | 1.0 |
| 25 | 75 | 1.75 |
| 0 | 100 | 2.25 |

Example 2 is included to demonstrate the desirable physical properties of the alkyl benzenes used in the oils of our invention compared to those of other alkyl benzenes.

EXAMPLE 2

Figure 1:
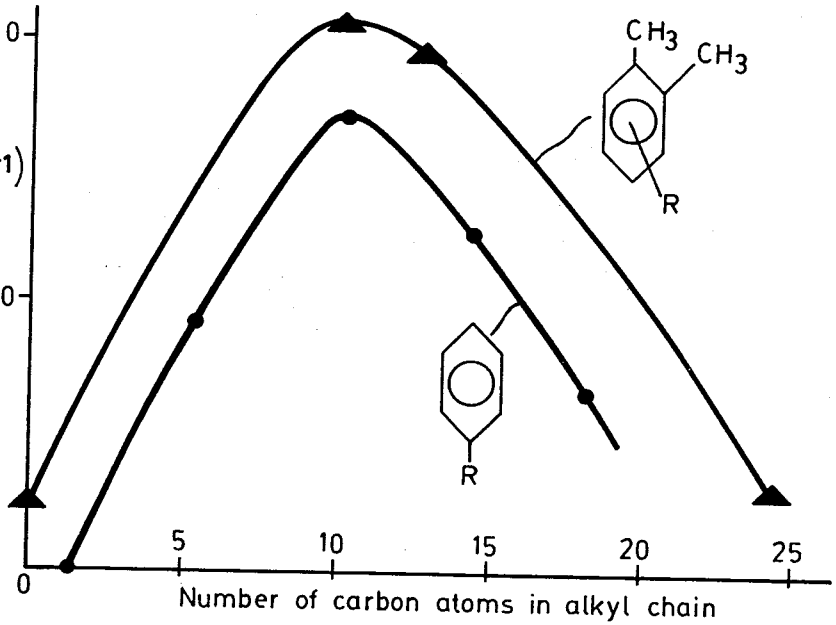
FIG. 1 shows the variation of hydrogen absorption coefficient K(hours$^{-1}$) depending upon the alkyl aromatic structure.

In order to compare trialkyl benzene and alkyl benzenes the hydrogen absorption of various alkyl benzenes and alkyl orthoxylenes were tested in the same manner as in Example 1 and the constant for speed of absorption ($k$) determined, the results we shown in the accompanying FIG. 1.

The $C_{12}$ alkyl orthoxylene used in Example 2 has a flash point of 150° C and a viscosity of 15.2 centistrokes of 100° F and 2.7 at 210$^F$ showing it to be particularly useful component of an electrical oil.

EXAMPLE 3

Figure 2:
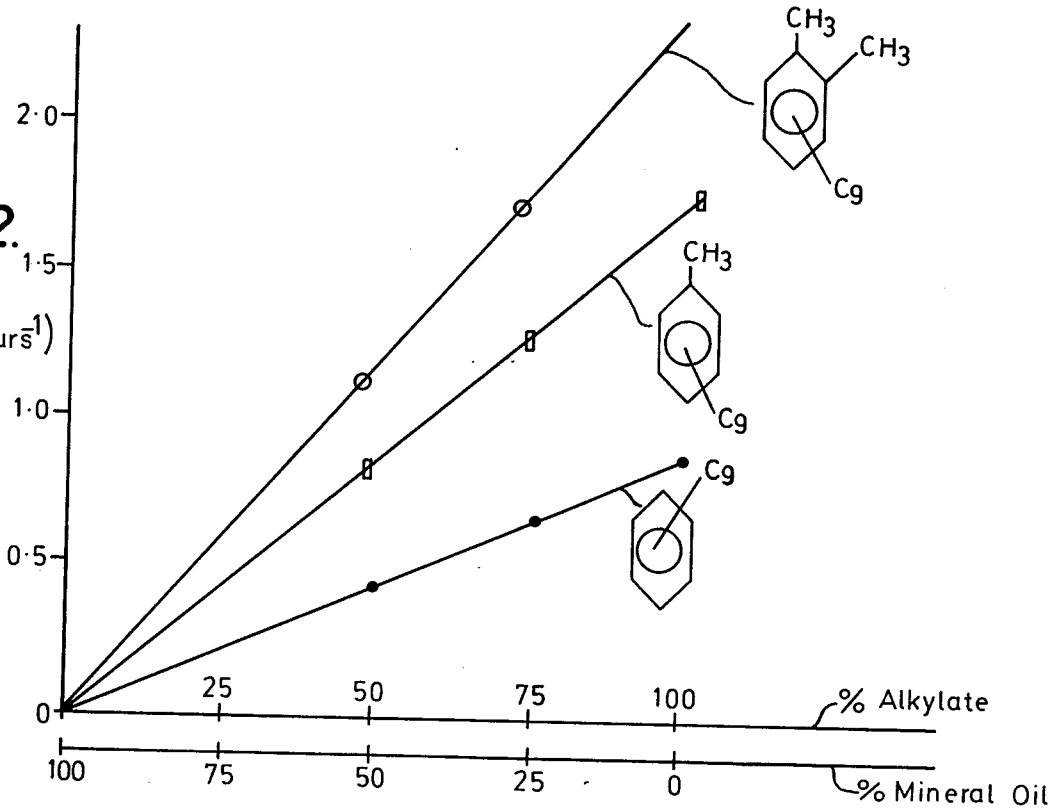
FIG. 2 shows the variation of the hydrogen absorption coefficient K(hours$^{-1}$) in blends of varying proportions of the alkyl aromatic and mineral oil depending upon the alkyl aromatic structure.

Parts of this Example are comparative and it is included to show the hydrogen absorption of various blends of nonyl orthoxylene, nonyl toluene and nonyl benzene with the mineral oil used in Example 1 and the results are shown in the accompanying FIG. 2.

We claim:

1. An electrical insulating oil having hydrogen absorption and oxidation stability comprising from 5 to 80% by weight of a trialkyl benzene of the general formula:

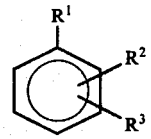

wherein $R_1$, $R_2$ and $R_3$ are all alkyl groups, with $R_1$ and $R_2$ containing no more than 6 carbon atoms and $R_3$ containing from 5 to 15 carbon atoms and from 95 to 20% by weight of a mineral oil.

2. An electrical insulating oil according to claim 1 in which $R_1$ and $R_2$ contain no more than 3 carbon atoms.

3. An electrical insulating oil according to claim 1, wherein said oil consists essentially of said trialkyl benzene and 25 to 35% of said mineral oil.

4. An electrical insulating oil according to claim 1 in which $R_3$ is selected from the group consisting of $C_9H_{19}$and $C_{12}H_{25}$ radicals.

5. An electrical insulating oil according to claim 1 containing from 25 to 85% by weight of the mineral oil.

6. An electrical insulating oil according to claim 1 in which $R_1$ and $R_2$ are both methyl groups and are in the ortho position relative to each other.

7. An electrical insulating oil according to claim 6, wherein $R_3$ is a nonyl group.

8. An electrical insulating oil according to claim 6, wherein $R_3$ is a dodecyl group.

* * * * *